US008820454B2

(12) United States Patent
Jost et al.

(10) Patent No.: US 8,820,454 B2
(45) Date of Patent: Sep. 2, 2014

(54) MOTORIZED WHEELCHAIR

(75) Inventors: Peter Jost, Kalletal (DE); Ralf Ritter, Bad Oeynhausen (DE)

(73) Assignee: Invacare International SARL, Gland (CH)

( * ) Notice: Subject to any disclaimer, the term of this patent is extended or adjusted under 35 U.S.C. 154(b) by 80 days.

(21) Appl. No.: 13/413,839

(22) Filed: Mar. 7, 2012

(65) Prior Publication Data

US 2012/0228042 A1 Sep. 13, 2012

(30) Foreign Application Priority Data

Mar. 7, 2011 (EP) ..... 11157165

(51) Int. Cl.
*A61G 5/04* (2013.01)

(52) U.S. Cl.
CPC ..... *A61G 5/04* (2013.01); *Y10S 180/907* (2013.01); *Y10S 180/908* (2013.01)
USPC ..... 180/68.5; 180/65.51; 180/907; 180/908

(58) Field of Classification Search
CPC ..... A61G 5/04
USPC ..... 180/907, 908, 68.5, 65.1, 65.51, 65.6
See application file for complete search history.

(56) References Cited

U.S. PATENT DOCUMENTS

| | | | | |
|---|---|---|---|---|
| 4,140,192 | A * | 2/1979 | Sharpe | 180/6.5 |
| 4,825,971 | A * | 5/1989 | Bernstein | 180/65.1 |
| 4,967,864 | A * | 11/1990 | Boyer et al. | 180/65.1 |
| 5,042,607 | A * | 8/1991 | Falkenson et al. | 180/208 |
| 5,156,226 | A * | 10/1992 | Boyer et al. | 180/65.1 |
| 5,996,716 | A * | 12/1999 | Montiglio et al. | 180/65.51 |
| 6,068,280 | A * | 5/2000 | Torres | 280/304.1 |
| 6,095,271 | A * | 8/2000 | Dickie et al. | 180/68.5 |
| 6,135,222 | A * | 10/2000 | Furukawa | 180/65.51 |
| 6,375,209 | B1 * | 4/2002 | Schlangen | 280/250.1 |
| 7,398,842 | B2 * | 7/2008 | Fontecchio et al. | 180/6.5 |
| 7,735,591 | B2 * | 6/2010 | Puskar-Pasewicz et al. | 180/68.5 |
| 8,037,953 | B2 * | 10/2011 | Puskar-Pasewicz et al. | 180/65.1 |
| 2001/0013437 | A1 * | 8/2001 | Husted et al. | 180/65.1 |

(Continued)

FOREIGN PATENT DOCUMENTS

| | | |
|---|---|---|
| EP | 0829247 | 3/1998 |
| EP | 0927551 | 7/1999 |
| EP | 1582189 | 10/2005 |
| EP | 2226048 | 9/2010 |

OTHER PUBLICATIONS

EP 11 15 7165 European Search Report, Aug. 4, 2011.

*Primary Examiner* — Hau Phan
*Assistant Examiner* — Jacob Meyer
(74) *Attorney, Agent, or Firm* — Calfee, Halter & Griswold LLP

(57) ABSTRACT

A motorized wheelchair includes a frame, a battery support assembly that supports a battery box and is connected to the frame, first and second power drive assemblies disposed on each lateral side of the wheelchair, first and second rear wheels driven by the power drive assemblies, and first and second castor wheels that are pivotally connected to said frame. The battery support assembly is pivotally connected to the frame by a first connecting arrangement, so that said battery support assembly can pivot around a first longitudinal axis. The battery support assembly is pivotally connected to the first connecting arrangement by a second connecting arrangement, so that the battery support assembly can pivot around a second lateral axis.

12 Claims, 4 Drawing Sheets

(56) References Cited

U.S. PATENT DOCUMENTS

2002/0088657 A1* 7/2002 Brett et al. ..... 180/68.5
2004/0144580 A1* 7/2004 Wu ..... 180/68.5
2006/0266565 A1* 11/2006 Fontecchio et al. ..... 180/6.5
2007/0181353 A1* 8/2007 Puskar-Pasewicz et al. 180/65.1
2008/0087481 A1* 4/2008 Grymko et al. ..... 180/68.5
2010/0065346 A1* 3/2010 Porcheron ..... 180/6.24

* cited by examiner

MOTORIZED WHEELCHAIR

RELATED APPLICATIONS

The present application claims the benefit of European Patent Application No. 11157165.9, filed on Mar. 7, 2011, which is incorporated herein by reference in its entirety.

TECHNICAL FIELD

The present invention relates to a motorized wheelchair. More particularly, the present invention relates to a construction of the chassis of a motorized wheelchair, which is as compact as possible.

Prior Art and the Problem Underlying the Invention

Power drive or motorized wheelchairs in general are known in the art to provide motorized mobility to persons confined to a wheelchair. Such power drive wheelchairs conventionally comprise a relatively sturdy wheelchair frame supported on wheels for rolling movement, in combination with one or more batteries for supplying electrical power to one or more electrical motors coupled to the drive wheels of the wheels. The wheelchair frame further carries a seat module including a seat and a backrest as well as armrests.

One of the problems associated with motorized wheelchairs is that they require large batteries to have a long drive range. These large batteries lead to enlarge the width of the wheelchair. Moreover, if one needs a faster motorized wheelchair, it is also imperative to use larger motors. Considering that the motors are generally positioned at the same level as the batteries in a conventional motorized wheelchair, it is often difficult to propose a motorized wheelchair possessing a high speed and a long drive range which has also a small width. The width of the wheelchair is important for the user, since it has a direct impact on how easy it is to drive through narrow doors.

In the state of art, EP 2 226 048 A1 reveals motorized wheelchairs in which the motors are fixed on swing arms located left and right of batteries, said swing arms being pivotally connected on the wheelchair frame. To avoid contact between the swing arms and the batteries during the wheelchair's motion, a space of about 1 to 1.5 cm between them is provided. This additional space is clearly an obstacle to reduce the lateral extension of the wheelchair.

Therefore, a first objective of the present invention is to provide a motorized wheelchair that is as compact as possible.

A second objective of the present invention is to provide a motorized wheelchair in which the rear wheel suspension is improved.

SUMMARY OF INVENTION

In an aspect, the present invention provides a motorized wheelchair comprising :

- a frame, defining a longitudinal direction and a lateral direction perpendicular to said longitudinal direction,
- a battery support assembly for supporting at least one battery box, said battery support assembly being connected to said frame,
- first and second power drive assemblies disposed on each lateral side of the wheelchair, each of the assemblies comprising a motor and a gearbox assembly,

- first and second rear wheels respectively driven by said first and second power drive assemblies,
- first and second castor wheels pivotally connected to said frame, wherein said first and second power drive assemblies are directly fixed on the battery support assembly, wherein said battery support assembly is pivotally connected to said frame by a first connecting arrangement, so that said battery support assembly can pivot around a first longitudinal axis, and wherein said battery support assembly is pivotally connected to said first connecting arrangement by a second connecting arrangement, so that said battery support assembly can pivot around a second lateral axis.

Further aspects and preferred embodiments are provided in the appended claims.

BRIEF DESCRIPTION OF THE DRAWINGS

The wheelchair of the present invention will be described in further detail further below, when useful with reference to the attached drawings, which show an exemplary wheelchair according to the invention.

DETAILED DESCRIPTION OF THE PREFERRED EMBODIMENTS

For the purpose of the present specification, situations and directions of elements of the wheelchair of the present invention are determined by the perspective of a user seated in the wheelchair. Accordingly, the left side of the wheelchair corresponds to the left side of FIGS. 2 and 4 or to the right side of FIGS. 1 and 3. The situations or directions "up" or "top" and "down" or "bottom", "rear" or "back" and "front", "behind" and "in front", "distal" and "proximal", "lateral" and "central" follow the same rule.

The present invention relates to a motorized wheelchair. The motorized wheelchair may be a dismountable wheelchair, meaning that at least a part of the wheelchair can be reversibly removed from the wheelchair. In this way, it is possible to remove at least one part, for example for the purpose of repairing the part or in order to arrange the wheelchair in a more space-saving manner, for example for storage and/or transport of the wheelchair.

Figure 1:
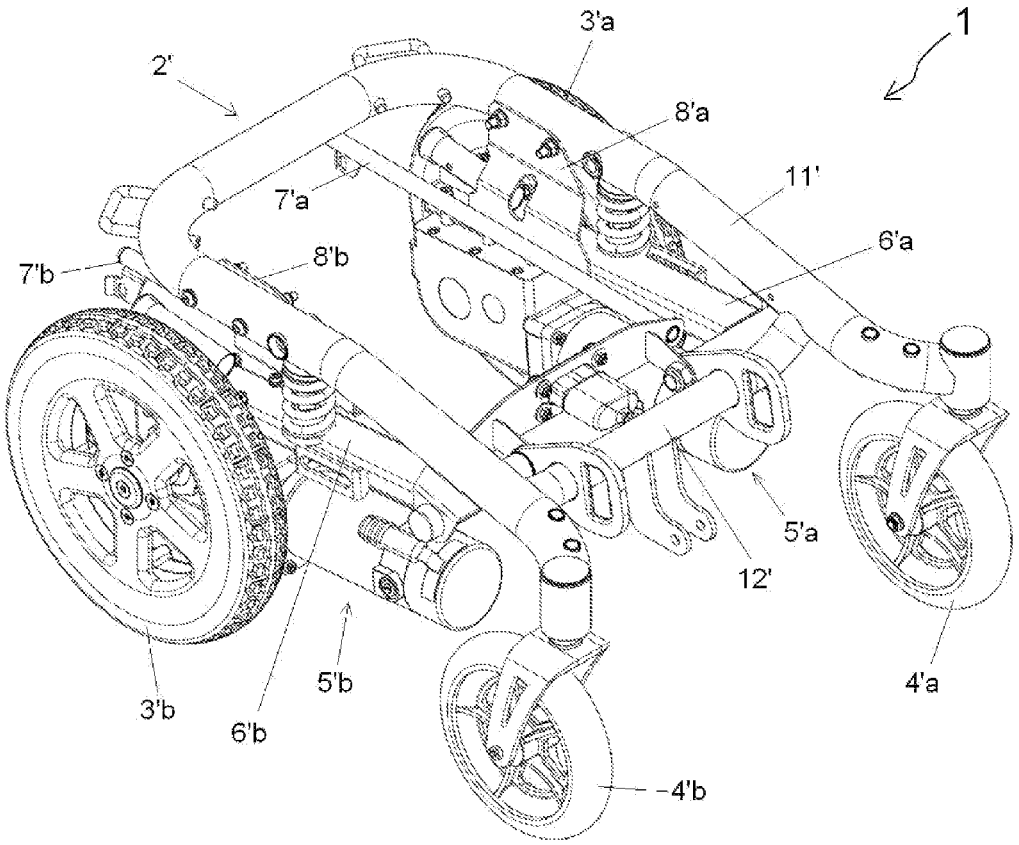
Fig.1 PRIOR ART
FIG. 1 is a front perspective view showing the base of a conventional motorized wheelchair, from which the seat construction, including armrests and legrests, and the battery boxes were removed.
Figure 2:
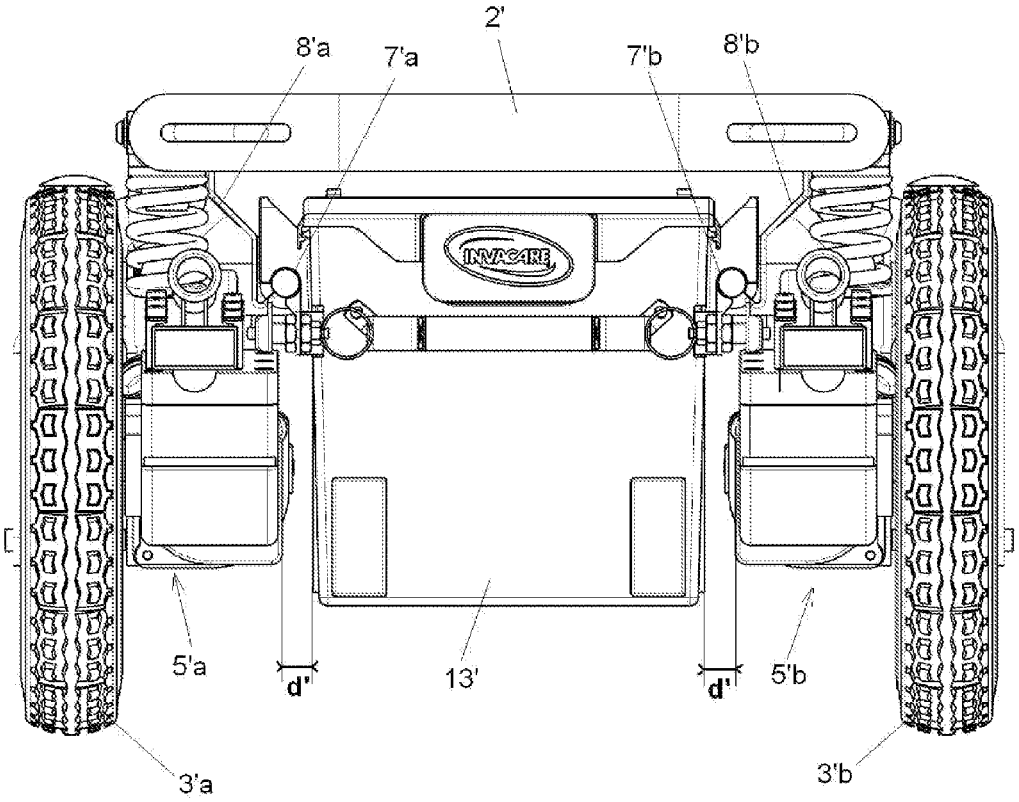
Fig.2 PRIOR ART
FIG. 2 is a rear view of the same wheelchair base as shown in FIG. 1, in which the battery boxes are replaced inside the base.

FIGS. 1 and 2 show a base of a conventional motorized wheelchair 1 with the seat, armrests and legrests of the wheelchair being removed for the reasons of clarity. Any one selected from the seat, the armrests, the legrests and/or the battery boxes may be demountable and remountable. The wheelchair of FIGS. 1 and 2 comprises a frame 2', said frame being formed by a main, U-shaped frame element 11', the open end of the U being oriented towards the front. A horizontal frame element 12' is provided in a front area of the frame 2'. Said wheelchair 1 comprises also a pair of left and right rear wheels 3'*a*, 3'*b* and a pair of left and right front castor wheels 4'a, 4'b. A pair of left and right power drive assemblies 5'a, 5'b, each assembly comprising a motor and a gear box assembly, are provided in order to propel the left and right rear wheels 3'a, 3'b, respectively. The castor wheels 4'a, 4'b are pivotally connected at the free ends of the U-shape element 11'. The rear wheels 3'a, 3'b are rotatably coupled to the gearbox assembly of the power drive assemblies 5'a, 5'b, respectively. The power drive assemblies 5'a, 5'b are supported by left and right swing arms 6'a, 6'b, respectively, said swing arms 6'a, 6'b being pivotally connected to the U-shape element 11' at their front ends. As best shown on FIG. 2, the free lateral space separating said swing arms 6'a, 6'b and said power drive assemblies 5'a, 5'b is configured to lodge at least one battery box 13'. The battery box 13' is supported by left and right longitudinal rails 7'a, 7'b, extending parallely along each lateral side of the battery box 13' and fixed on the frame 2' by left and right connection plates 8'a and 8'b. When the battery box 13' is in its position of use, one can see on FIG. 2 that the left, respectively right, side of the battery box 13' is separated from the gear box of the left, respectively right, power drive assembly 5'a, respectively 5'b, by a distance d'. This distance d' is necessary to prevent that a contact between the battery box 13' and the gear box occurs during the wheelchair's motion. The distance d' is generally chosen so as to be comprised between 1 cm and 1.5 cm. Thus, in this conventional wheelchair 1, the width of the frame 2' encompasses up to 3 cm of useless space. The aim of the invention is therefore to provide a new construction reducing this useless space.

Figure 3:
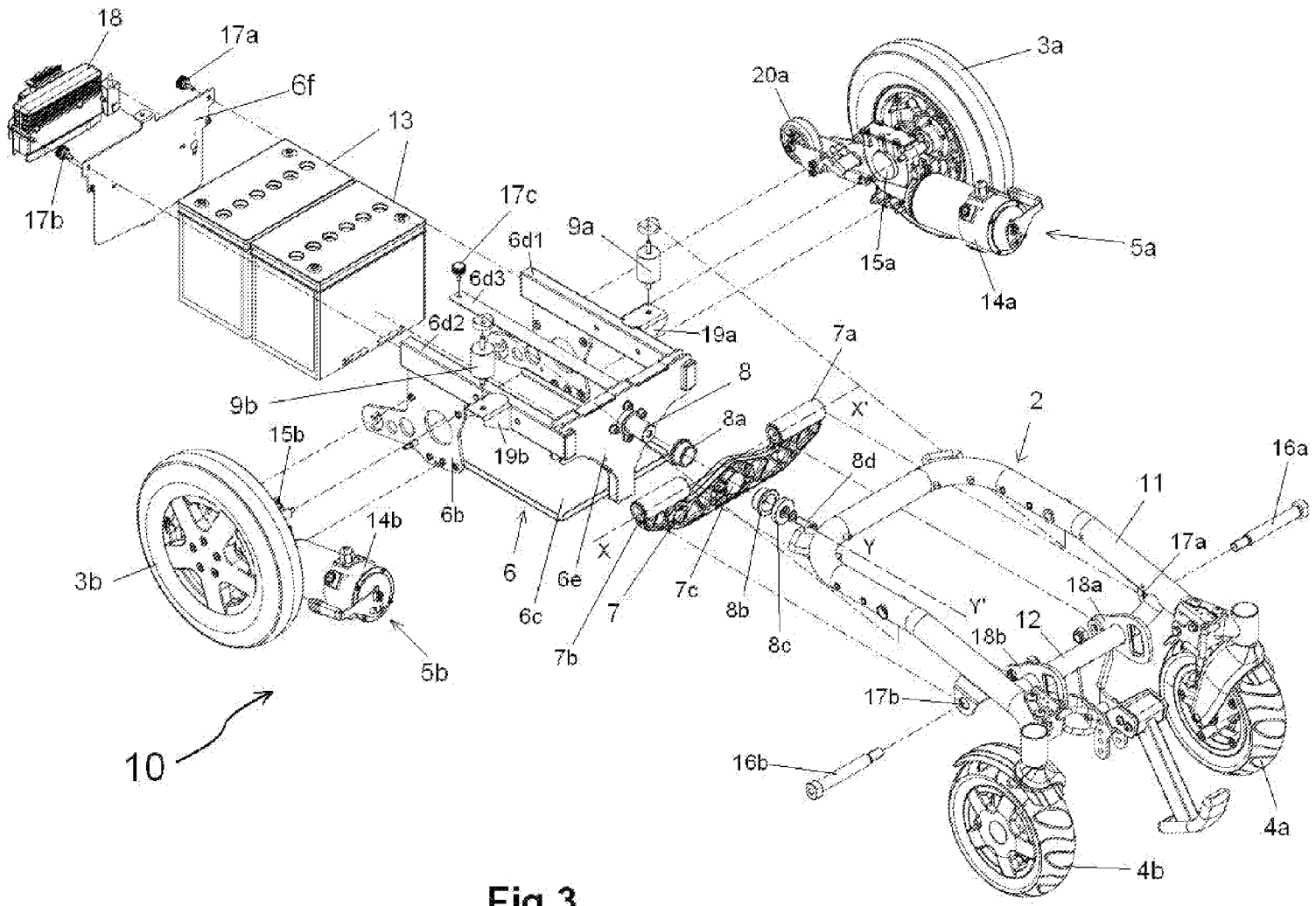
FIG. 3 is an exploded front perspective view showing the base of a wheelchair according to an embodiment of the invention, from which the seat construction, including armrests and legrests, is removed.

FIG. 3 shows a base of a motorized wheelchair 10 according to the invention with the seat, armrests and legrests of the wheelchair being removed for the reasons of clarity. Any one selected from the seat, the armrests, the legrests and/or the battery boxes may be dismountable and remountable. The wheelchair 10 comprises a frame 2, said frame being formed by a main, U-shaped frame element 11, the open end of the U being oriented towards the front, each leg of the U defining the longitudinal direction of the wheelchair 10 and the bottom of the U defining the lateral direction of the wheelchair 10, said lateral direction being perpendicular to said longitudinal direction. A horizontal frame element 12 is provided in a front area of the frame 2. Said wheelchair 10 comprises also a pair of left and right rear wheels 3*a*, 3*b* and a pair of left and right front castor wheel 4*a*, 4*b*. A pair of left and right power drive assemblies 5*a*, 5*b*, each assembly comprising a motor 14*a*, 14*b* and a gear box assembly 15*a*, 15*b*, are provided in order to propel the left and right rear wheels 3*a*, 3*b*, respectively. Each power drive assembly 5*a*, 5*b* comprises also a forked structure at its rear extremity, said forked structure rotatably supporting an anti-tip wheel 20*a*, 20*b*. The castor wheels 4*a*, 4*b* are pivotally connected at the free ends of the U-shape element 11. The rear wheels 3*a*, 3*b* are rotatably coupled to the gearbox assemblies 15*a*, 15*b* of the left and right power drive assemblies 5*a*, 5*b*, respectively. The gear box assemblies 15*a*, 15*b* of the left and right power drive assemblies 5*a*, 5*b* are fixedly and directly connected to the lateral sides of a battery support assembly 6 by screws or other similar means of connection. Said battery support assembly 6 is configured to support at least one battery box 13. In the illustrated embodiment, said battery box 13 having an approximately parallelepipedical form, said battery support assembly 6 defines approximately a parallelepipedical housing, said housing being defined, at its lateral sides, by left and right connecting plates 6*a*, 6*b*, on which is connected the left and right power drive assemblies 5*a*, 5*b*, respectively, at its lower side, by a plate 6*c*, supporting the lower side of said battery box 13, at its upper side, by three parallel crossbars 6*d*1, 6*d*2, 6*d*3, respectively positioned at the left, right and central part of said housing, said crossbars 6*d*1 and 6*d*2 extending above said left and right connecting plates 6*a*, 6*b*, respectively, and, at its rear side, by a rear plate 6*f*, which is fixedly connected to said crossbars 6*d*1, 6*d*2, 6*d*3 by three screws 17*a*, 17*b*, 17*c*, respectively, said rear plate 6*f* supporting at its rear side a socket 18 which is electrically connected to the battery box 13. At its front end, the battery support assembly 6 comprises also a front connecting plate 6*e*, which is pivotally connected to a bracket 7, so that said battery support assembly 6 can pivot around a longitudinal axis YY'. In the illustrated embodiment, the axis YY' is enclosed in a vertical plane of symmetry for the wheelchair 10. A wide variety of connecting arrangements can be implemented to allow the battery support assembly 6 to pivot around the axis YY'. The illustrated connection arrangement connecting said connecting plate 6*e* and said bracket 7 comprises a cylindrical element 8 fixedly connected to said connecting plate 6*e* and extending in the axial direction YY' from the front side of said plate 6*e*, said cylindrical element 8 being disposed, at least partially, inside a cylindrical hole 7*c* formed in the center part of said bracket 7, the internal diameter of said hole 7*c* being higher than the external diameter of said cylindrical element 8. This configuration permits to lodge in said hole 7*c*, between said element 8 and said bracket 7, a first and second annular bushing 8*a*, 8*b*, introduced inside said hole 7*c* from the rear and front sides, respectively, said element 8, said bushings 8*a*, 8*b* and said bracket 7 being connected together by a screw 8*d* engaging a threaded hole of said element 8 and acting against an end washer 8*c* which is in contact with said bushing 8*b*. However, any connection arrangement that allows the battery support assembly 6 to pivot around the axis YY' can be used. In an exemplary embodiment, the battery support assembly is also pivotable about axis XX'. This pivoting about axis XX' can be achieved in a variety of different ways. In the illustrated embodiment, said bracket 7 is also configured to pivotally connect said battery support assembly 6 to the wheelchair frame 2, so that said battery support assembly 6 can pivot around a lateral axis XX'. However, any connection arrangement that allows the battery support arrangement to pivot about axis XX' can be used. In the illustrated embodiment, said axis XX' is approximately perpendicular to said axis YY'. Thus, said bracket 7 comprises at its left and right upper sides a left and right tubular connecting elements 7*a*, 7*b*, respectively, said elements 7*a*, 7*b* extending in the axial direction XX' and being in contact at their lateral ends with a pair of connecting plates 17*a*, 18*a* and 17*b*, 18*b*, respectively, of the wheelchair frame 2. Said connecting plates 17*a*, 18*a*, 17*b*, 18*b* are each perforated with a hole aligned in the axial direction XX' with the axial apertures of said elements 7*a*, 7*b* so that two left and right bolts 16*a*, 16*b* permit the pivoting connection between said bracket 7 and said wheelchair frame 2. Finally, the battery support assembly 6 is connected to the underside of each leg of the U-shape frame element 11 by at least two shock absorbers 9*a*, 9*b* so as to restrain the pivoting movement of said battery support assembly 6 around the first axis XX' and/or the second axis YY'. In the illustrated embodiment, said shock absorbers 9*a*, 9*b* consist in rubber springs, the lower side of said rubber springs 9*a*, 9*b* being supported by the central part of two U-shape elements 19*a*, 19*b* fixedly connected to the crossbars 6*d*1 and 6*d*2, respectively. However, any type of shock absorber or spring may be used.

Figure 4:
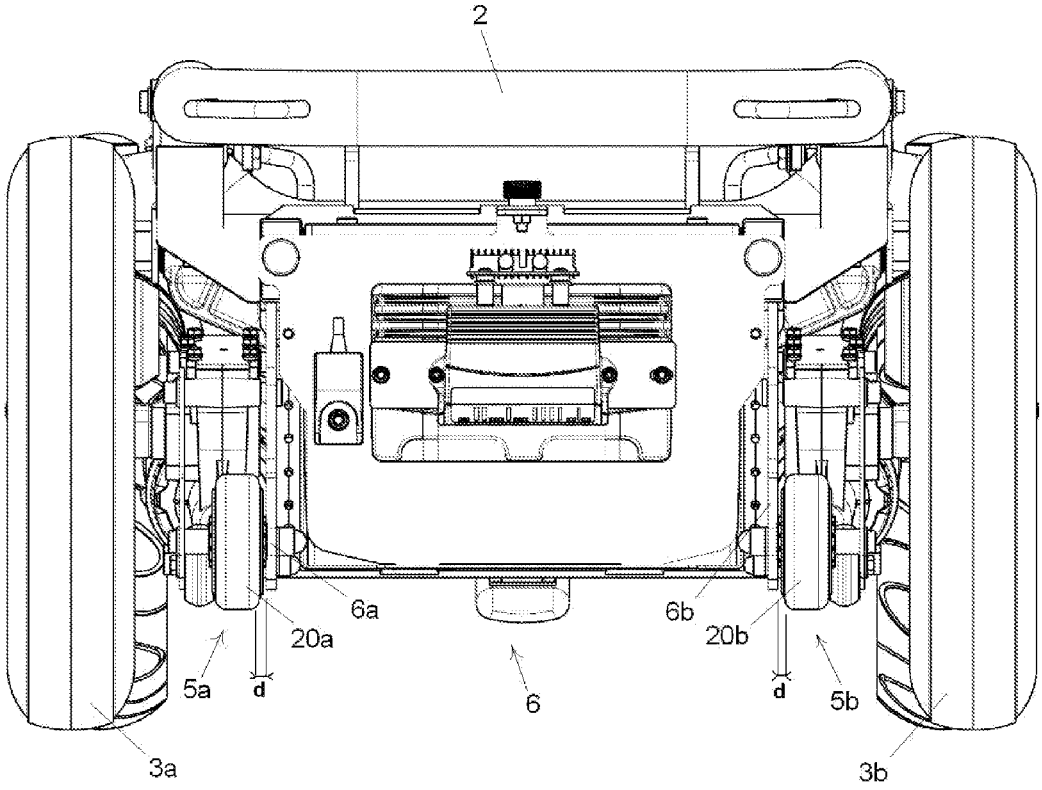
FIG. 4 is a rear assembled view of the wheelchair base of FIG. 3.

FIG. 4 is a rear assembled view of the wheelchair base of FIG. 3. One can see on FIG. 4 that the left, respectively right, connecting plate 6*a*, respectively 6*b*, of the battery support assembly 6 is separated from the gear box of the left, respectively right, power drive assembly 5*a*, respectively 5*b*, by a distance d. This distance d depends only on the connecting means used to connect said power assemblies 5*a*, 5*b* to said battery support assembly 6. Indeed, contrary to the conventional wheelchair of FIGS. 1 and 2, the distance d between said battery support assembly 6 and said power drive assemblies 5*a*, 5*b* does not vary during the wheelchair's motion, because these two elements are fixedly connected together. Therefore, the distance d is generally less than 0.5 cm, and preferably less than 0.1 cm.

The invention claimed is:

1. A motorized wheelchair comprising:

a frame , defining a longitudinal direction and a lateral direction perpendicular to said longitudinal direction, a battery support assembly for supporting at least one battery box , said battery support assembly being connected to said frame , first and second power drive assemblies disposed on each lateral side of the wheelchair , each of the assemblies comprising a motor and a gearbox assembly , first and second rear wheels respectively driven by said first and second power drive assemblies , first and second castor wheels pivotally connected to said frame, wherein said first and second power drive assemblies are directly fixed on the battery support assembly, wherein a first connecting arrangement pivotally connects said battery support assembly to a second connecting arrangement, so that said battery support assembly can pivot around a longitudinal axis in a front-to-back direction, and wherein said battery support assembly is pivotally connected to said frame by the second connecting arrangement, so that said battery support assembly can pivot around a lateral axis in a side-to-side direction.

2. The wheelchair of the preceding claim 1, wherein the distance separating at least one of said first and second power drive assemblies and said battery support assembly in the lateral direction is less than 0.5 cm, preferably less than 0.1 cm, and more preferably approximately null.

3. The wheelchair of the preceding claim 1, wherein said lateral axis being approximately perpendicular to said longitudinal axis.

4. The wheelchair of the preceding claim 1, wherein said second connecting arrangement comprises a bracket provided at its left and right upper sides with left and right tubular connecting elements, respectively, said tubular connecting elements extending along the first longitudinal axis and being in contact at their lateral ends with a pair of connecting plates, respectively, of the frame, said connecting plates being each perforated with a hole aligned in the axial direction with the axial apertures of said tubular connecting elements so that two left and right bolts permit the pivoting connection between said bracket and said frame.

5. The wheelchair of the preceding claim 1, wherein said first connecting arrangement comprises a bracket provided at its upper side with at least one cylindrical connecting element, said cylindrical connecting element extending along the first longitudinal axis and being pivotally connected to the frame, in particular by a ball bearing or a roller bearing, so as to permit the pivoting connection between said bracket and said frame.

6. The wheelchair of the preceding claim 4, wherein said first connecting arrangement comprises a cylindrical element fixedly connected to the battery support assembly and extending in the axial direction from the front side of said battery support assembly, said cylindrical element being disposed, at least partially, and rotatably movable inside a cylindrical hole formed in the center part of said bracket.

7. The wheelchair of the preceding claim 1, wherein said battery support assembly is connected to the underside of said frame by at least one shock absorber so as to restrain the pivoting movement of said battery support assembly around at least one of said longitudinal axis and lateral axis.

8. The wheelchair of the preceding claim 7, wherein said battery support assembly is connected to the underside of said frame by at least two shock absorbers disposed at each lateral side of said frame.

9. The wheelchair of the preceding claim 7, wherein said shock absorbers consist in springs providing three degrees of freedom.

10. The wheelchair of the preceding claim 9, wherein said shock absorbers consist in rubber spring.

11. The wheelchair of the preceding claim 1, wherein the frame is formed by a main, U-shaped frame element, the open end of the U being oriented towards the front, each leg of the U defining the longitudinal direction of the wheelchair and the bottom of the U defining the lateral direction of the wheelchair.

12. The wheelchair of the preceding claim 4, wherein said battery support assembly defines approximately a parallelepipedical housing, said housing being defined, at its lateral sides, by left and right connecting plates, on which is connected the left and right power drive assemblies, respectively, at its lower side, by a plate, supporting the lower side of said battery box, at its upper side, by three parallel crossbars, respectively positioned at the left, right and central part of said housing, said left and right crossbars extending above said left and right connecting plates, respectively, at its rear side, by a rear plate, which is fixedly connected to said crossbars by three screws, respectively, and at its front side, by a front connecting plate, which is pivotally connected to the bracket.

* * * * *